US007633227B2

(12) United States Patent
Dekkers et al.

(10) Patent No.: US 7,633,227 B2
(45) Date of Patent: Dec. 15, 2009

(54) DISCHARGE LAMP WITH LAMP BASE STRUCTURE

(75) Inventors: Guy Jozef Maria Dekkers, Turnhout (BE); Elisabeth Onnekes-Van Der Voort, Turnhout (BE)

(73) Assignee: Koninklijke Philips Electronics N.V., Eindhoven (NL)

( * ) Notice: Subject to any disclaimer, the term of this patent is extended or adjusted under 35 U.S.C. 154(b) by 319 days.

(21) Appl. No.: 10/574,147

(22) PCT Filed: Oct. 1, 2004

(86) PCT No.: PCT/IB2004/051938

§ 371 (c)(1),
(2), (4) Date: Mar. 29, 2006

(87) PCT Pub. No.: WO2005/033802

PCT Pub. Date: Apr. 14, 2005

(65) Prior Publication Data

US 2007/0114942 A1 May 24, 2007

(30) Foreign Application Priority Data

Oct. 3, 2003 (EP) ..... 03103674

(51) Int. Cl.
*H01J 17/04* (2006.01)
*H01J 61/04* (2006.01)

(52) U.S. Cl. ..... 313/631; 313/318.01; 313/634

(58) Field of Classification Search ..... 313/567, 313/623, 631, 634, 318.01
See application file for complete search history.

(56) References Cited

U.S. PATENT DOCUMENTS 5,412,275 A * 5/1995 Dorsemagen et al. .. 313/318.01
5,592,049 A * 1/1997 Heider et al. ..... 313/625

FOREIGN PATENT DOCUMENTS

EP 429256 A * 5/1991
GB 476836 A * 12/1937

* cited by examiner

*Primary Examiner*—Toan Ton
*Assistant Examiner*—Kevin Quarterman

(57) ABSTRACT

The invention relates a high-pressure discharge lamp, which comprises:

Figure 1:
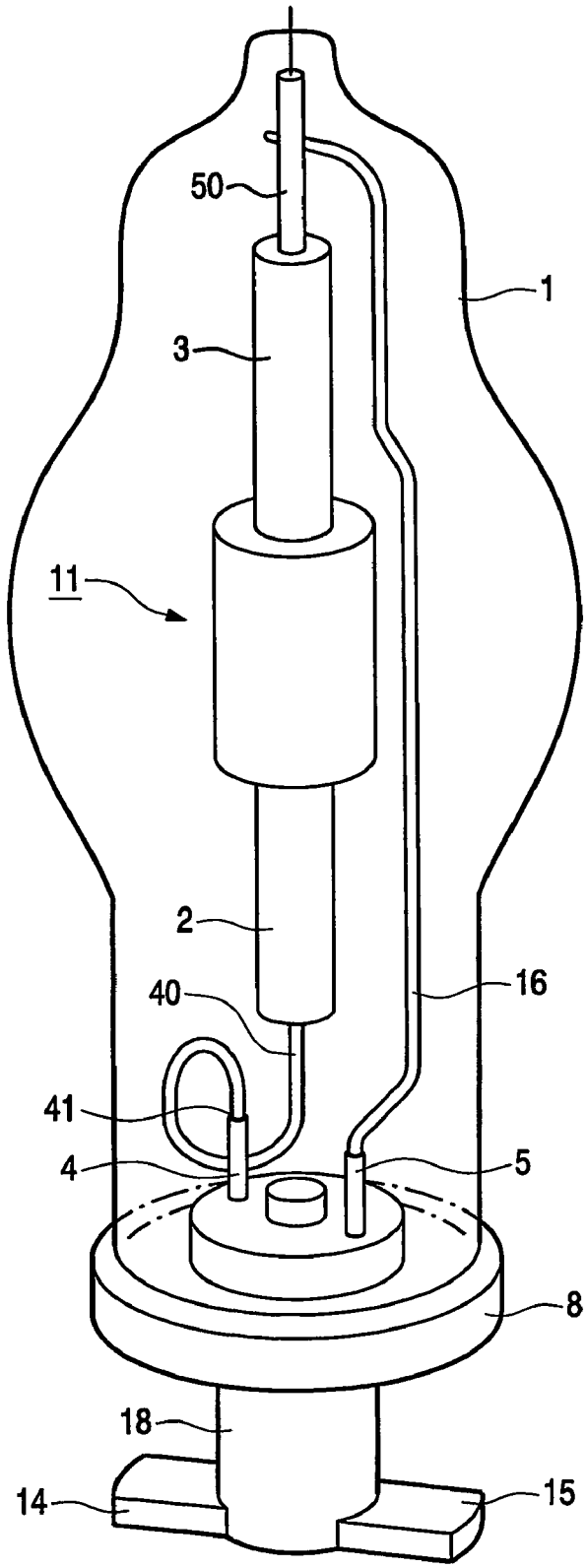

an outer bulb (1) in which a discharge vessel (11) is arranged around a longitudinal axis (22), the discharge vessel enclosing, in a gastight manner, a discharge space (13) provided with an ionizable filling, the discharge vessel having a first (2) and a second (3) mutually opposed portion forming a first and a second leadthrough through which a first (40) and a second (50) leadthrough conductor, respectively, extend to a pair of electrodes (6,7) arranged in the discharge space, a lamp base (8) of electrically insulating material supporting the discharge vessel via a first (4) and a second (5) current supply conductor, each having a weld with the respective first and second leadthrough conductor, forming a first and a second current path to the pair of electrodes, the lamp base also supporting the outer bulb, the outer bulb enclosing the first and second current supply conductors, the outer bulb being connected to the lamp base in a gas-tight manner, the lamp base being provided with first (14) and second (15) contact members connected electrically to the respective first and second current supply conductors.

10 Claims, 3 Drawing Sheets

DISCHARGE LAMP WITH LAMP BASE STRUCTURE

The invention relates to a high-pressure discharge lamp.

High-pressure discharge lamps ranging from 35 to 150 W have become a dominant player in lighting retail applications. Trends have emerged which create positive conditions for range extensions towards lower lumen packages and/or lower wattages. Lower light levels are being used, for instance in exclusive shops, focusing the light on the goods instead of flooding the area. End users in the market become more and more interested in a uniform quality of the light and would prefer to employ high-pressure discharge lamps instead of using halogen lamps for the low lumen packages and accent lighting.

Generally, high-pressure discharge lamps of the kind mentioned in the opening paragraph either have a discharge vessel with a ceramic wall or have a quartz glass discharge vessel. Such high-pressure discharge lamps are widely used in practice and combine a high luminous efficacy with favorable color properties. The discharge vessel of the lamp contains one or several metal halides in addition to Hg and a rare gas filling.

A ceramic wall of a discharge vessel in the present description is understood to be a wall preferably made from one of the following materials: monocrystalline metal oxide (for example sapphire), translucent densely sintered polycrystalline metal oxide (for example Al2O3, YAG), and translucent densely sintered polycrystalline metal nitride (for example AlN).

A lamp of the kind mentioned in the opening paragraph is known from the English abstract of JP-A 04 002 035(1992). The known discharge lamp comprises a discharge vessel and current supply conductors supporting the discharge vessel while installed projectively at a lamp base of an insulating material. An outer bulb of which one end is left open is fixed to the lamp base enclosing the discharge vessel and the current supply conductors.

In the known lamp each lead through conductor is connected to its respective current supply conductor by means of an additional conducting metal strip separately fastened to each of the both conductors. Suitable ways of fastening are resistance welding, clamping, crimping and combinations. The thus formed construction is complicated, which makes it vulnerable to production faults resulting in production loss. This is a drawback.

The invention has for its object to counteract the draw back above indicated. According to the invention the high-pressure discharge lamp comprises:

an outer bulb (1) in which a discharge vessel (11) is arranged around a longitudinal axis (22), the discharge vessel enclosing, in a gastight manner, a discharge space (13) provided with an ionizable filling, the discharge vessel having a first (2) and a second (3) mutually opposed portion comprising a first and a second leadthrough through which a first (40) and a second (50) leadthrough conductor, respectively, extend to a pair of electrodes (6,7) arranged in the discharge space, a lamp base (8) of electrically insulating material supporting the discharge vessel via a first (4) current supply conductor, having a weld (41) with the first leadthrough conductor, and a second (5) current supply conductor electrically connected to the second leadthrough conductor, together forming a respective first and a second current path to the pair of electrodes, the lamp base also supporting the outer bulb, the outer bulb enclosing the first and second current supply conductors, the outer bulb being connected to the lamp base in a gastight manner, the lamp base being provided with first (14) and second (15) contact members connected electrically to the respective first and second current supply conductors.

In an advantageous embodiment the first current path of the $1^{st}$ current supply conductor and the $1^{st}$ leadthrough conductor has a $1^{st}$ section (A) extending from the $1^{st}$ leadthrough along the longitudinal axis towards the lamp base, a $2^{nd}$ section (B) bended away extending effectively traverse to the longitudinal axis, and a $3^{rd}$ section (C) extending towards the first contact member.

Preferably the $2^{nd}$ section of the first current path comprises two U-bends (UB1, UB2). Preferably each U-bend is lying in a mutual different plane. In a further embodiment the two U-bends are separated by an intermedate part (BS), for instance a straight part. Alternatively the two U-bends form part of a helix. By using mutual different planes for the U-bends further miniaturization of the lamp construction is promoted.

In a further prefered embodiment of a lamp according to the invention the weld of the $1^{st}$ current supply conductor with the $1^{st}$ leadthrough conductor is in the $3^{rd}$ section of the $1^{st}$ current path. The shaping of the current path then substantially takes place by the leadthrough conductor, which is chosen to have a thermal expension coefficient matching to the ceramic wall material. Suitable materials like Nb, Mo and Zr also posses a reasonable to high degree of ductility, which is advantageous for shaping and in absorbing differences in thermal expansion between the leadthrough conductor and the current supply conductor.

The weld of the $1^{st}$ current supply conductor with the $1^{st}$ leadthrough conductor is preferably a butt-weld. A particular advantage of the construction with a butt-weld is the suitability of a butt-weld to be formed in an oxidizing atmosphere, like air. Thus lamp fabrication can be kept relative simple without the need of a special controlled atmosphere during the mounting process of the discharge vessel on the base plate.

Figure 2:
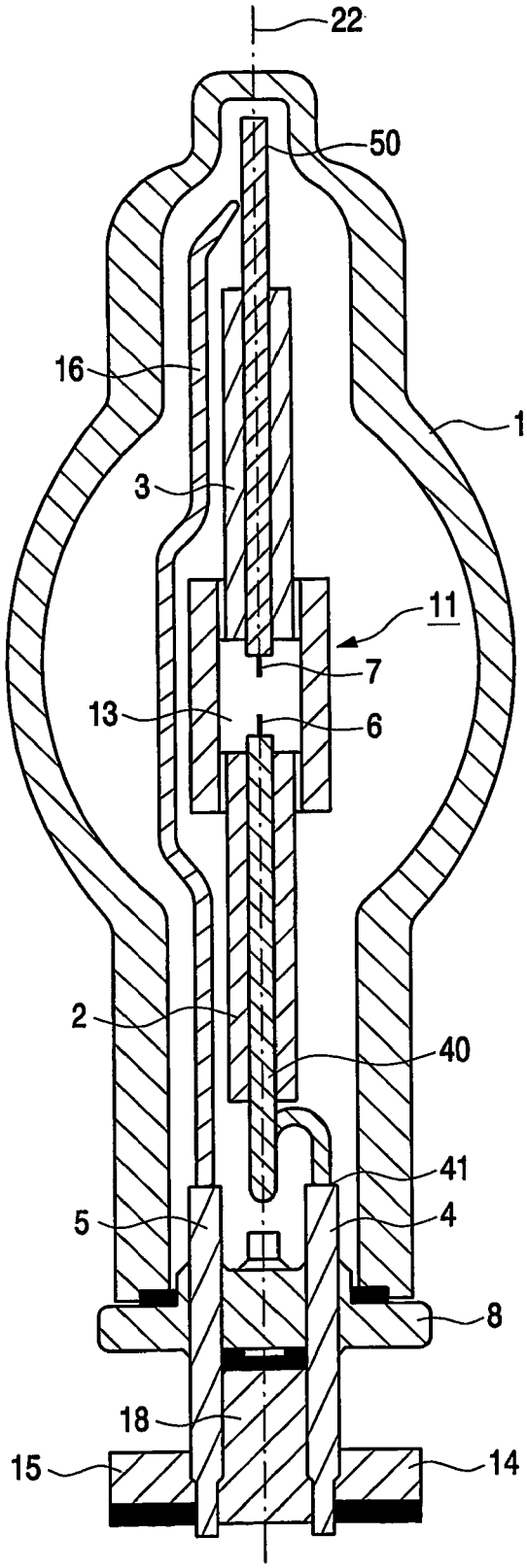
Figure 3:
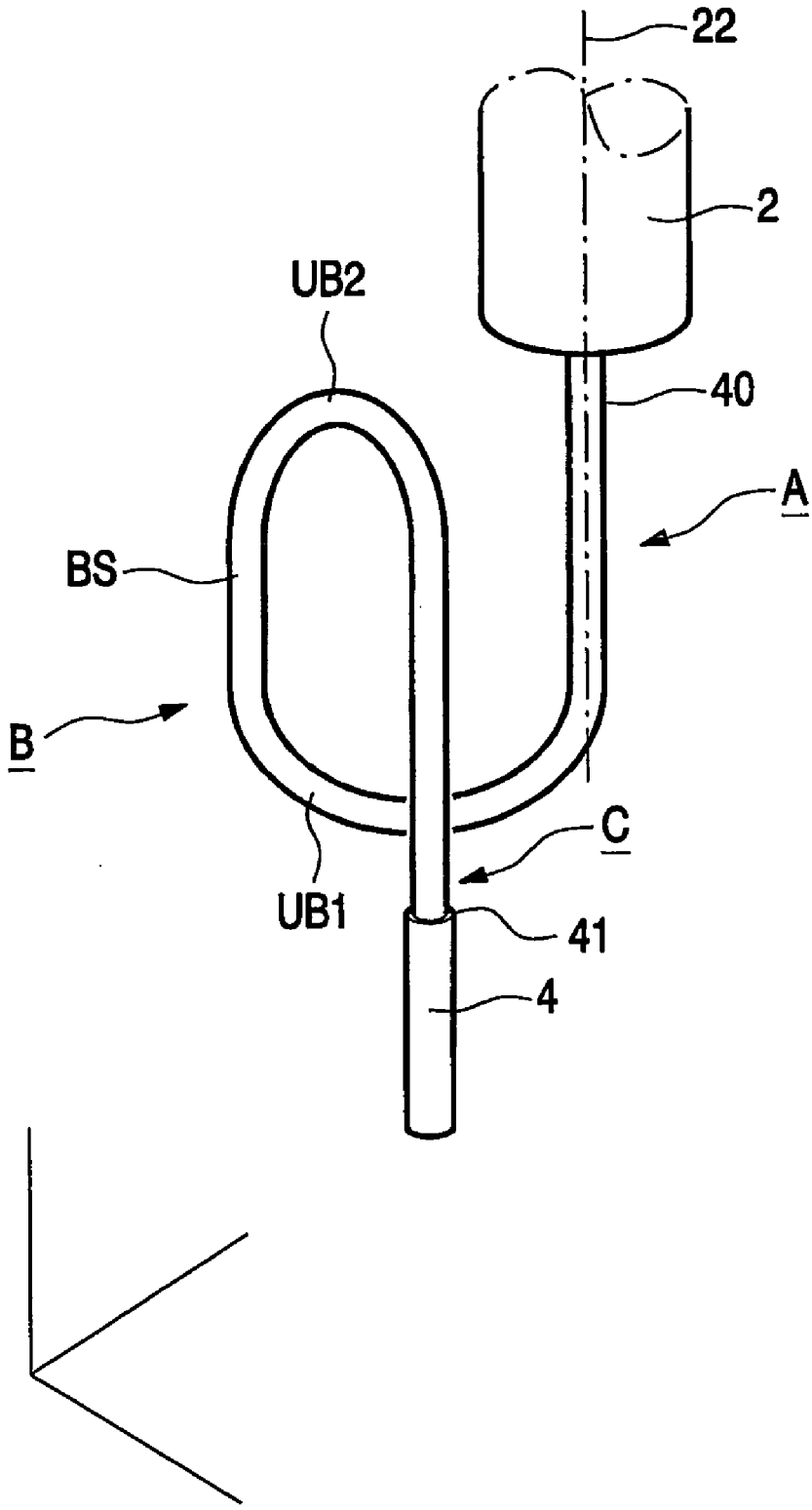

Generally in the leadthrough the leadthrough conductor is sealed to the discharge vessel wall by means of a sealing frit, which tends to creep over the conductor surface for some length. By selecting the $1^{st}$ section of the $1^{st}$ current path to have a length of at least 1 mm, preferably about 2 mm the location of the bending of the conductor in forming the $2^{nd}$ section will then be free of sealing frit The invention will be explained in more detail with reference to a drawing (not to scale) in which:

FIG. 1 diagrammatically shows a high-pressure discharge lamp according to the invention, FIG. 2 a cross-section of the lamp as shown in FIG. 1, and FIG. 3 shows in detail a part of current supply conductor construction of the lamp of FIG. 1.

FIGS. 1 and 2 show a high-pressure discharge lamp according to the invention, which comprises:

an outer bulb 1 in which a discharge vessel 11 is arranged around a longitudinal axis 22, the discharge vessel enclosing, in a gastight manner, a discharge space 13 provided with an ionizable filling, the discharge vessel having a first 2 and a second 3 mutually opposed portion comprising a first and a second leadthrough through which a first 40 and a second 50 leadthrough conductor, respectively, extend to a pair of electrodes 6,7 arranged in the discharge space, a lamp base 8 of electrically insulating material supporting the discharge vessel via a first 4 current supply conductor, having a weld 41 with the first leadthrough conductor 40, and a second 5 current supply conductor electrically connected to the second leadthrough conductor 50 via a lead-back conductor 16, together forming a respective first and a second current path to the pair of electrodes, the lamp base also supporting the outer bulb, the outer bulb enclosing the first and second current supply conductors, the outer bulb being connected to the lamp base in a gas-tight manner, the lamp base being provided with first 14 and second 15 contact members connected electrically to the respective first and second current supply conductors.

In the shown embodiment the mutually opposed portions of the discharge vessel through which first and second leadthrough conductors extend, are neck-shaped, which is preferred to have the leadthrough formed by the sealing of the leadthrough conductor to the ceramic material at a location which will stay relatively cool during lamp operation. In the shown embodiment the leadthrough conductors are sealed to the ceramic neck-shaped portions at the end of each neck-shaped portion pointing away from the discharge space by means of a sealing fit (not shown in the drawing) in a way well known in the art. The thus formed leadthroughs form hermetic sealings of the discharge vessel. Alternative leadthrough constructions are well known in the art, for instance formed by a cermet being gastight sintered to the ceramic end portion. Preferably, an exhaust tube 18 for evacuating the outer envelope 1 is provided in the lamp base 8. In this manner, the outer envelope 1 can be evacuated after the discharge vessel 11 and the outer bulb 1 have been mounted on the lamp base 8. In an alternative embodiment the exhaust tube 18 may also form in the lamp base 8 a feed through tube of one of the current supply conductors to its respective contact member.

In FIG. 3 a part of current supply conductor construction forming the $1^{st}$ current path is shown in detail. The first current path has a $1^{st}$ section A extending from the $1^{st}$ leadthrough along the longitudinal axis 22 towards the lamp base, a $2^{nd}$ section B bended away extending effectively traverse to the longitudinal axis, and a $3^{rd}$ section C extending towards the first contact member.

The $2^{nd}$ section B of the first current path comprises two U-bends UB1, UB2 separated by an intermedate straight part BS, each U-bend lying in a mutual different plane. In the shown configuration U-bend UB1 is in a plane through the longitudinal axis 22 and U-bend UB2 in a plane substantially traverse to the plane U-bend UB1 is located in.

In the shown embodiment the $1^{st}$ A, $2^{nd}$ B and $3^{rd}$ C sections of the $1^{st}$ current path are formed by the leadthrough conductor 40. The $3^{rd}$ section C is welded to the current supply conductor 4 at the butt-weld 41.

A suitable material for use as leadthrough conductor is Nb. It closely matches the thermal expansion rate of ceramic and has a high degree of ductility, which has the advantage that at the one hand the necessary bending as part of the current path will be easily performed and on the other hand has a large absorbing capacity for absorbing differences in thermal expansion between current supply conductor and discharge tube.

A practical embodiment of the lamp described in the drawing has a nominal power of 22 W, generating during stable operation light with a color temperature of about 3000K with an efficacy of about 70 lm/W. The filling of the discharge vessel comprises 2.2 mg Hg and 5.5 mg iodide salts of Na, Tl, Dy, Ho and Tm in a mol percentage 85, 9, 2, 2 and 2.

The overall length of the outer bulb and lamp base measured along the longitudinal axis of the lamp is 44 mm. The greatest diameter of the outer bulb is 17 mm. The length of the discharge vessel inclusive the neck-shaped portions is 28 mm. The disharge space has an internal diameter of 4.6 mm. Of the $1^{st}$ leadthrough conductor the $1^{st}$ section A extending from the $1^{st}$ leadthrough along the longitudinal axis towards the lamp base has a length of about 2 mm.

In an alternative embodiment of a lamp according to the invention the end portions of the discharge vessel incorporating the leadthroughs consist of ceramic disks closing the discharge space.

The shape of the discharge space in the shown embodiment is cylindrical. However, any other shape, like for instance spherical, tapered and combinations, is suitable for application in a lamp according the invention.

The invention claimed is:

1. A high-pressure discharge lamp comprising:

an outer bulb in which a discharge vessel is arranged around a longitudinal axis, the discharge vessel enclosing, in a gastight manner, a discharge space provided with an ionizable filling, the discharge vessel having a first and a second mutually opposed portion forming a first and a second leadthrough through which a first and a second leadthrough conductor, respectively, extend to a pair of electrodes arranged in the discharge space, a lamp base of electrically insulating material supporting the discharge vessel via a first current supply conductor, having a weld with the first leadthrough conductor, and a second current supply conductor electrically connected to the second leadthrough conductor, forming a respective first and a second current path to the pair of electrodes, the lamp base also supporting the outer bulb, the outer bulb enclosing the first and second current supply conductors, and being connected to the lamp base in a gas-tight manner, wherein the first leadthrough conductor includes:

a $1^{st}$ section extending from the $1^{st}$ leadthrough along the longitudinal axis towards the lamp base, a $2^{nd}$ section bended away extending effectively transverse to the longitudinal axis, wherein the $2^{nd}$ section of the first leadthrough conductor comprises two U-bends, and a $3^{rd}$ section extending towards the first contact member.

2. The high-pressure discharge lamp of claim 1, wherein each U-bend is lying in a mutual different plane.

3. The high-pressure discharge lamp of claim 1, wherein the two U-bends are separated by an intermediate part.

4. The high-pressure discharge lamp of claim 3, wherein the intermediate part is a straight part.

5. The high-pressure discharge lamp of claim 1, wherein the weld of the first current supply conductor with the first leadthrough conductor is a butt-weld.

6. The high-pressure discharge lamp of claim 1, wherein the $1^{st}$ section has a length of at least 1 mm.

7. A high-pressure discharge lamp comprising:

an outer bulb in which a discharge vessel is arranged around a longitudinal axis, the discharge vessel enclosing, in a gastight manner, a discharge space provided with an ionizable filling, the discharge vessel having a first and a second mutually opposed portion forming a first and a second leadthrough through which a first and a second leadthrough conductor, respectively, extend to a pair of electrodes arranged in the discharge space, a lamp base of electrically insulating material supporting the discharge vessel via a first current supply conductor, having a weld with the first leadthrough conductor, and a second current supply conductor electrically connected to the second leadthrough conductor, forming a respective first and a second current path to the pair of electrodes, the lamp base also supporting the outer bulb, the outer bulb enclosing the first and second current supply conductors, and being connected to the lamp base in a gas-tight manner, wherein the first leadthrough conductor includes:

a $1^{st}$ section extending from the $1^{st}$ leadthrough along the longitudinal axis towards the lamp base, a $2^{nd}$ section bended away extending effectively transverse to the longitudinal axis, and a $3^{rd}$ section extending towards the first contact member, wherein the weld of the first current supply conductor with the first leadthrough conductor is in the $3^{rd}$ section of the first leadthrough conductor.

8. A discharge bulb comprising:

a vessel enclosing, in a gastight manner, a discharge space provided with an ionizable filling, the discharge vessel having a first and a second mutually opposed portion forming a first and a second leadthrough, and a first and a second leadthrough conductor that extend, respectively, to a pair of electrodes arranged in the discharge space, the first leadthrough conductor being shaped with a plurality of bends that facilitate direct connection to a current supply conductor in a lamp base, wherein the first leadthrough conductor includes:

a $1^{st}$ section extending from the first leadthrough along a longitudinal axis of the discharge bulb, a $2^{nd}$ section bended away extending effectively traverse to the longitudinal axis, wherein the $2^{nd}$ section of the first leadthrough conductor includes two U-bends, and a $3^{rd}$ section extending along the longitudinal axis.

9. The discharge bulb of claim 8, wherein each U-bend is lying in a mutual different plane.

10. The discharge bulb of claim 8, wherein the $2^{nd}$ section of the first leadthrough conductor includes a straight element between the two U-bends.

* * * * *